US007685650B2

(12) United States Patent
Cotten

(10) Patent No.: US 7,685,650 B2
(45) Date of Patent: Mar. 30, 2010

(54) OILSKIN-TYPE WATER-TIGHT AND AIR-TIGHT PROTECTIVE GARMENT

(75) Inventor: Guy Cotten, Concarneau (FR)

(73) Assignee: Establissements Guy Cotten, Tregunc (FR)

( * ) Notice: Subject to any disclaimer, the term of this patent is extended or adjusted under 35 U.S.C. 154(b) by 68 days.

(21) Appl. No.: 11/523,034

(22) Filed: Sep. 19, 2006

(65) Prior Publication Data

US 2007/0061948 A1 Mar. 22, 2007

(30) Foreign Application Priority Data

Sep. 19, 2005 (FR) ..... 05 52808

(51) Int. Cl.
*A41D 3/04* (2006.01)

(52) U.S. Cl. ..... 2/87; 2/93

(58) Field of Classification Search ..... 2/102, 2/82, 93, 87, 456, 97, 458, 2.16, 267, 22
See application file for complete search history.

(56) References Cited

U.S. PATENT DOCUMENTS 2,259,560 A * 10/1941 Glidden ..... 428/134
4,338,686 A * 7/1982 Bell ..... 2/93
4,416,641 A 11/1983 Spinosa et al.
4,569,874 A * 2/1986 Kuznetz ..... 428/109
4,780,359 A * 10/1988 Trask et al. ..... 442/224
4,807,303 A * 2/1989 Mann et al. ..... 2/69
4,864,656 A * 9/1989 Nesse ..... 2/97
4,868,928 A * 9/1989 Norvell ..... 2/272
5,072,455 A * 12/1991 St. Ours ..... 2/81
RE33,966 E * 6/1992 Robison ..... 2/82
5,150,476 A * 9/1992 Statham et al. ..... 2/93
5,364,678 A * 11/1994 Lumb et al. ..... 428/96
5,459,874 A * 10/1995 Meredith ..... 2/67
5,867,828 A 2/1999 Shih et al.
5,920,902 A * 7/1999 Crampton ..... 2/24
5,920,915 A * 7/1999 Bainbridge et al. ..... 2/456
6,018,819 A * 2/2000 King et al. ..... 2/69
6,032,300 A * 3/2000 Bainbridge et al. ..... 2/456
6,055,676 A * 5/2000 Bainbridge et al. ..... 2/456
6,112,328 A * 9/2000 Spector ..... 2/69
6,167,571 B1 1/2001 Cheng
6,263,511 B1 * 7/2001 Moretti ..... 2/97
6,272,684 B1 * 8/2001 Shih ..... 2/87
6,279,162 B1 * 8/2001 Silverthorn ..... 2/108
6,357,054 B1 * 3/2002 Bainbridge et al. ..... 2/455

(Continued)

FOREIGN PATENT DOCUMENTS

FR 2374860 7/1978

*Primary Examiner*—Alissa L Hoey
(74) *Attorney, Agent, or Firm*—Young & Thompson

(57) ABSTRACT

The invention relates to a protective garment made of water-tight and air-tight outer cloth formed by superimposing an external layer of a film of polyvinyl chloride and an internal layer of woven cloth, the film and the woven cloth being bonded together. At least one section of the garment is lined internally by a lining made with cloth and including a foam sheet extending in the lining, the cloth of the lining being bonded at least on its periphery to the woven section of the external cloth in bonding zones, the foam sheet being arranged substantially free between the cloth of the lining and the external cloth, the foam sheet being integral with the external cloth and/or with the cloth of the lining at least towards its upper section in order to be held and not fall in the lining. The garment can be a vest, a pair of trousers or an apron.

13 Claims, 1 Drawing Sheet

U.S. PATENT DOCUMENTS

| | | | | |
|---|---|---|---|---|
| 6,427,242 | B1 * | 8/2002 | Bush et al. | 2/69 |
| 6,446,273 | B1 * | 9/2002 | Gillen et al. | 2/455 |
| 6,453,477 | B1 * | 9/2002 | Bainbridge et al. | 2/455 |
| 6,490,735 | B2 * | 12/2002 | Rindle | 2/98 |
| 6,618,860 | B1 * | 9/2003 | Sullivan et al. | 2/159 |
| 6,859,948 | B2 * | 3/2005 | Melts | 2/456 |
| 7,028,341 | B2 * | 4/2006 | Ikenaga et al. | 2/102 |
| 7,043,767 | B2 * | 5/2006 | Jaeger | 2/87 |
| 7,111,327 | B1 * | 9/2006 | Blauer et al. | 2/82 |
| 2002/0164474 | A1 * | 11/2002 | Buckley | 428/308.4 |
| 2003/0033659 | A1 * | 2/2003 | Ikenaga et al. | 2/102 |
| 2007/0026186 | A1 * | 2/2007 | Chapuis | 428/57 |

* cited by examiner

OILSKIN-TYPE WATER-TIGHT AND AIR-TIGHT PROTECTIVE GARMENT

The present invention relates to an oilskin-type water-tight and air-tight protective garment which may be provided as in particular a vest, a pair of trousers, an apron. It is intended for being worn by people wishing to be protected from a hostile environment, such as strong winds, humidity, water (rain, sea sprays, breakers . . . ).

BACKGROUND OF THE INVENTION

Water-tight and air-tight garments are used widely in professions or in leisure activities where users wish to be protected from the environment. However, such tightness exhibit certain shortcomings due to the fact that the internal space of the garment, on the user side, is insulated from the outside and consequently, water in the form of steam or liquid, for example sweat, cannot be discharged efficiently. Moreover, waters steam (sweat) is generally at a temperature greater than that of the outer environment of the garment and it has a tendency to condensate on the cold sections of the garment. There results that the inside of the garment becomes eventually covered with a water film, due to condensation, whereof the presence and the physical features (notably thermal conduction) will cause an unpleasant feeling to the user and, as well, compromise the quality of the thermal insulation of the garment. These sensations and effects mainly take place in the tightened zones, i.e. wherein the garment is in contact with the user and especially the tightened section or the upper sections of the garment, the lower sections being generally more ample in order to confer a certain freedom of movement to the user.

SUMMARY OF THE INVENTION

The invention relates to a water-tight and air-tight garment which avoids said effects by implementing an inner lining, the lining including a flexible foam sheet of plastic matter which enables to separate/insulate the external section of the garment which is exposed to the environment, from the user who is therefore not in direct contact with a cold section any longer. Moreover, the foam may exhibit further advantages, for example a dampening or cushioning effect as in the case when a life vest, a harness, possibly a rucksack, worn on a garment which is a vest. Preferably, the lining is arranged in the sections of the vest which are in closest contact with the user: the tightest sections, which corresponds generally to the top of the vest. For a garment which is a pair of trousers, the lining(s) are preferably situated at the thighs and/or between the legs, possibly the breeches for overalls-type trousers.

The invention therefore provides a protective garment made of an external cloth (it is the main cloth forming the garment, here qualified as outer cloth, in order to differentiate it from the cloth of the lining which is inside the garment) water-tight (steam and liquid) and air-tight formed by superimposing an external layer of a film of polyvinyl chloride (PVC) and an internal layer of woven cloth, the film and the woven section being bonded (integral) together.

According to the invention, at least one section of the garment is lined internally by a lining made with cloth (the external cloth and the cloth of the lining are of same constitution) and including moreover a foam sheet extending in said lining, the cloth of the lining being bonded at least on its periphery to the woven section of the external cloth in bonding zones, the foam sheet being arranged substantially free (it is substantially free on surface: it is not bonded over the whole surface to the cloth but it may be bonded at certain spots spaced over its surface, it is conversely retained in the lining so as not to fall) between the cloth of the lining and the external cloth, said foam sheet being integral with the external cloth and/or with the cloth of the lining at least towards its upper section in order to be held and not to fall in said lining.

The garment of the invention is preferably a vest, a tunic, a pair of trousers (overalls-type or classical covering the bottom of the body: up to the waist), a coat with breeches or an apron and more generally anything which may be used for covering and protecting the human body and which exhibits tightened zones and/or in contact with the body and whereon humidity, in particular sweat, has a tendency to condensate in the case of a normal garment without the lining of the invention. These zones which are hence preferably lined, are intended for a vest-type garment (possibly for the breeches of an overalls/a coat or of a life jacket/breeches) the top of the shoulders, the top of the back and of the breast, for a garment such as trousers the top of the thighs (possibly the abdomen if the trousers rises above the waist: overalls/coat), for an apron-type garment the abdomen.

The invention also relates therefore to an oilskin-type protective apron made of a water-tight and air-tight external cloth formed by superimposing an external layer of a film of polyvinyl chloride and an internal layer of woven cloth, the film and the woven cloth being bonded together, wherein at least the front section of the apron in relation to the abdomen is lined internally by a lining made with cloth and including moreover a foam sheet extending in said lining, the cloth of the lining being bonded at least on its periphery to the woven section of the external cloth in bonding zones, the foam sheet being arranged substantially free between the cloth of the lining and the external cloth, said foam sheet being integral with the external cloth and/or with the cloth of the lining at least towards its upper section in order to be held and not to fall in said lining.

The invention also relates therefore to a pair of oilskin-type protection trousers made of a water-tight and air-tight external cloth formed by superimposing an external layer of a film of polyvinyl chloride and an internal layer of woven cloth, the film and the woven cloth being bonded together, wherein at least the front section of the trousers in relation to the thighs is lined internally by a lining made with cloth and including moreover a foam sheet extending in said lining, the cloth of the lining being bonded at least on its periphery to the woven section of the external cloth in bonding zones, the foam sheet being arranged substantially free between the cloth of the lining and the external cloth, said foam sheet being integral with the external cloth and/or with the cloth of the lining at least towards its upper section in order to be held and not to fall in said lining.

In the case of a pair of trousers exhibiting an abdominal upper prolongation, the front section of the trousers in relation to the abdomen is lined internally by a lining made with cloth and including moreover a foam sheet extending in said lining, the cloth of the lining being bonded at least on its periphery to the woven section of the external cloth in bonding zones, the foam sheet being arranged substantially free between the cloth of the lining and the external cloth, said foam sheet being integral with the external cloth and/or with the cloth of the lining at least towards its upper section in order to be held and not to fall in said lining.

The invention also relates therefore to a an oilskin-type sleeved protective vest made of a water-tight and air-tight external cloth formed by superimposing an external layer of a film of polyvinyl chloride and an internal layer of woven cloth, the film and the woven cloth being bonded together, wherein at least one section of the vest is lined internally by a lining made with cloth and including moreover a foam sheet extending in said lining, the cloth of the lining being bonded at least on its periphery to the woven section of the external cloth in bonding zones, the foam sheet being arranged substantially free between the cloth of the lining and the external cloth, said foam sheet being integral with the external cloth and/or with the cloth of the lining at least towards its upper section in order to be held and not to fall in said lining.

In various embodiments of the invention, the following means which may be used individually or according to all the technically possible combinations, are employed:

the foam sheet is in a closed space (lining with continuous water-tight peripheral bonding)

the woven section is made of polyester, the woven section is made of polyamide, the foam sheet is bonded to the cloth along upper peripheral edges, (upper section of the garment, for example the neck of a vest, the upper section of the abdomen for an overalls/a coat)

the foam sheet is bonded to the cloth along upper lines, (upper section of the garment in the middle of the foam sheet, for example along the ridge of the shoulder)

the foam sheet is bonded along its whole periphery to the cloth, the foam sheet is bonded to the cloth in certain spots spaced of its surface, the foam sheet has a thickness ranging between 2 mm and 6 mm, the foam sheet has a thickness ranging between 2 mm and above 6 mm, the film of polyvinyl chloride and the woven section bonded together forming the cloth correspond to a polyamide or polyester woven section coated with polyvinyl chloride, (i.e. a coated cloth)

for the trousers, the lining is arranged towards the top of the thighs, (towards the front of the section of the trousers corresponding to the thighs)

for the trousers, the lining is arranged at the belt, (tightened contour of the trousers)

for the trousers, in case when it is of rising type, the lining is arranged in relation to the abdomen, (towards the front of the upper section of the trousers corresponding to the abdomen)

for the apron, the lining is arranged in relation to the abdomen, (towards the front of the apron corresponding to the abdomen)

for the vest, the lining is arranged at the upper section of the vest, on the shoulders and on the upper sections of the thorax and of the back by running above the proximal apertures (towards the shoulders) of sleeves, said lining being more extended vertically on the back than on the thorax, for the vest, the lining is arranged in the sleeves, at least at their upper sections, the bonding zones are continuous bands arranged at the periphery of the cloth of the lining and closing the inside of said lining substantially water-tight and air-tight, the lining with its foam sheet is moreover sewn at least towards its upper section to the cloth, the vest is a substantially vertical aperture complete from top to bottom by the front, the aperture including one or several of the following removable closing means: Velcro® (i.e., a hook-and-loop fastener) or similar, zip fastener, snap buttons, the aperture of the vest is edged with a covering lapel, the vest does not include any apertures by the front, said vest being slipped over the head, the vest is formed of an overlapping abutting assembly of panels cut in the cloth, the vest includes four panels, a neck upper panel, a back lower panel and two lateral lower panels, the upper panel including cut-outs and bondings intended for forming the sleeves, each lateral edge of the back lower panel abutting against a corresponding lateral edge of the corresponding lateral lower panel along a substantially vertical bonding zone starting substantially at the lower section of the proximal end of the corresponding sleeve, (hollow in the joint of the shoulder), for the vest at least one of the lateral lower panels includes a pocket which can be accessed externally, said pocket being made by continuous peripheral bonding a piece of the cloth on the woven section (internal face) of the vest, the lateral lower panel including an aperture emerging in the internal space delineated by the peripheral bonding of the piece, the lining is formed of a single panel made of cloth, the lining is formed of several panels, the lining being composed of an overlapping abutting assembly of panels cut in the cloth, the lining is formed of several panels, at least one of the panels being independent from one another and including its own foam sheet, the cloth of the lining has the same orientation as the external cloth of the garment, the film of the lining being opposite the woven section of the external cloth, the cloth of the lining has an orientation opposite that of the external cloth of the vest, the woven section of the lining being opposite the woven section of the external cloth, preferably the foam has closed cells, the foam has open cells, the foam with closed cells is made of light insulation material, the foam made of a material selected among polyvinyl chloride (PVC), polyurethane, polyethylene, the distal end (towards the hands) of each of the sleeves includes internally an added elastic sleeve intended for closing said sleeve around the end of the corresponding upper member of the user of the vest, the vest includes moreover a hood, the hood is made by assembling two panels of cloth, bonded to the upper section of the vest, the hood includes in a peripheral sheath a sliding thread intended for tightening the hood on the user's head, the hood includes a lining, the hood is moreover sewn to the vest.

The lining implemented in the garment behaves therefore like a kind of <<double glazing>> which provides increased insulation on sections of said garment which are usually exposed to condensation and/or wherein the body of the subject is substantially in contact with the garment such as for example in the upper sections: shoulders for the vests or breeches of rising trousers and/or tightened trousers: belt zone of trousers, and/or exposed to frictions: thighs for a pair of trousers.

Moreover, the foam sheet being sandwiched between two water-tight cloths and confined in a closed space (continuous peripheral bonding of the cloths around the foam sheet), the foam is insulated simultaneously from the external environment and from the subject: there is no risk of absorbing humidity. The maintenance of the garment is thereby simplified (i.e. washing with large quantities of water). The materials of the cloth enable water-tight bondings.

The garment of the present invention, without being limited thereto, will now be exemplified with a vest in the description below in relation to the following FIGURE:

DETAILED DESCRIPTION OF THE INVENTION

Figure 1:
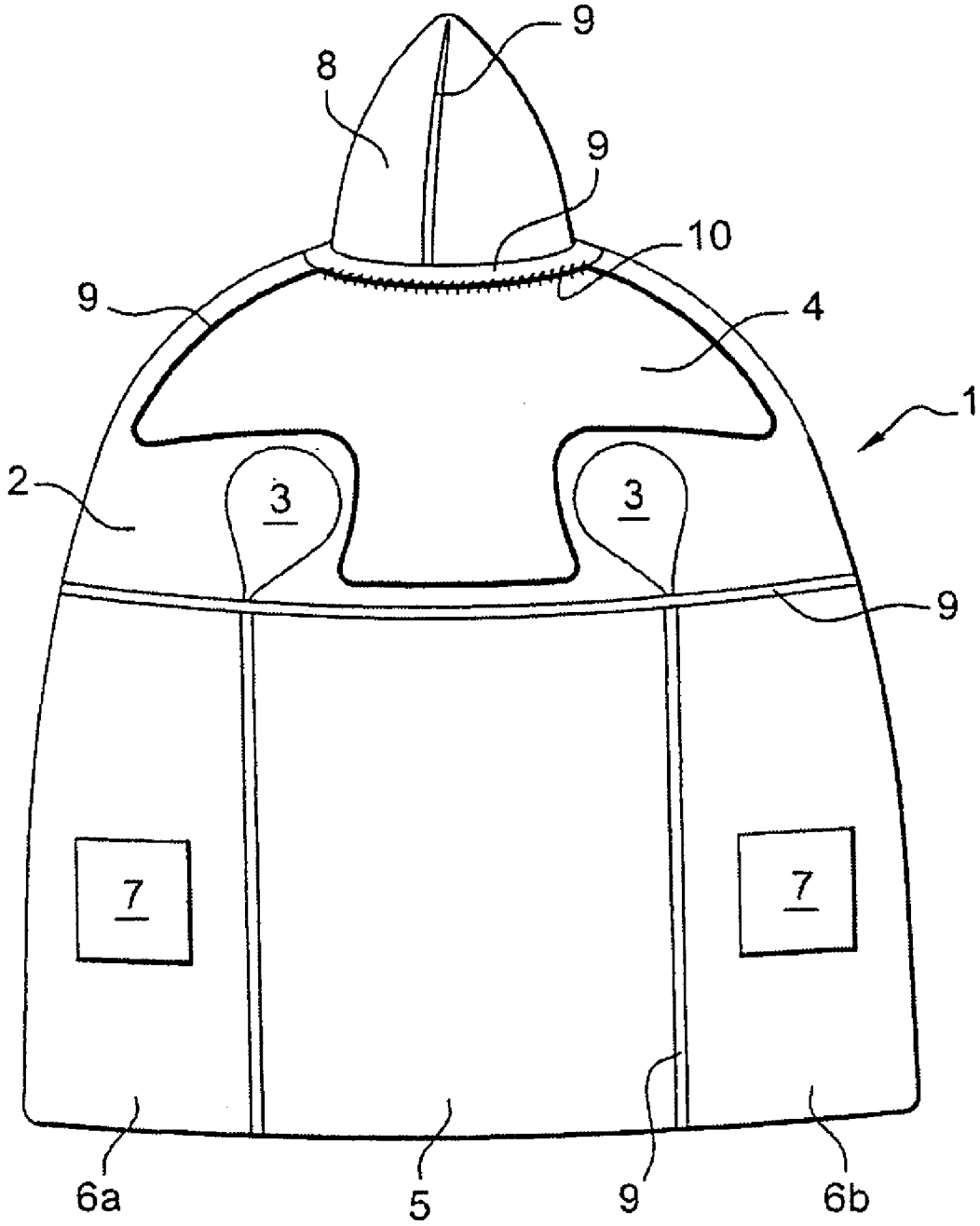
FIG. 1 which represents schematically a vest laid substantially flat and seen from the inside.

The vest 1 of the invention, in the example represented, is substantially symmetrical with respect to a middle vertical axis and formed by assembling panels cut in a cloth which is water-tight, water in liquid or steam form, and air-tight, formed of the superposition of an external layer (in contact with the environment) of a film of polyvinyl chloride and of an internal layer (towards the user) of a woven section of polyester, the film and the woven cloth being bonded together and forming a coated cloth. The vest of the FIG. 1 includes four panels, a neck upper panel 2, a back lower panel 5 and two lateral lower panels 6*a* and 6*b*, the upper panel 2 including cut-outs and bondings intended for forming the sleeves 3 which are hence made in the upper panel 2. Each lateral edge of the back lower panel 5 abuts against a corresponding lateral edge of the corresponding lateral lower panel 6*a* or 6*b* respectively, along a substantially vertical bonding zone 9 starting substantially at the lower section of the proximal end of the corresponding sleeve 3. The panels are interconnected together by bonding along bonding zones which form continuous bonded bands 9. The bonding ensures proper tightness between the panels. The bondings are made by ultrasounds. A primary seam with thread may possibly strengthen the interconnection between the panels, the bonding which is then made enabling to embed the seam thread in the plastic material of the cloth and thereby providing the tightness of said seam.

The section of the vest lined internally by a lining made with cloth and which includes moreover internally a foam sheet extending in said lining, is the upper section of the vest. In this view, a panel 4 made in cloth is bonded inside the vest after having placed the foam sheet inside. At the lining the garment hence exhibits in its thickness from the outside towards the inside: an external cloth (the coated cloth forming mainly the garment), an insulator in the form of a foam sheet then a cloth of internal lining in the same type of coated cloth as that of the external cloth.

In practice the cloth panel of the lining has dimensions slightly greater than the foam sheet (or the sheets) therein contained. For maintaining the foam sheet in the lining, the foam sheet is bonded to the cloth preferably on all its contour and possibly on certain spots spaced on the surface. The bonding forms a peripheral continuous band with the panel 4 of the lining which provides tightness inside the lining and hence for the foam sheet. To provide such tightness, the foam sheet should not protrude from the panel 4 of the lining, at the most, in particular towards its upper section, to reach the limit or just before, said lining panel 4. The latter possibility corresponds to the interconnection of the foam sheet with the upper section of the vest (neck) so that it is held and does not fall in said lining, the foam sheet being arranged substantially free on the surface between the lining and the vest (bonding spots with the cloth may be provided at certain surface spots of the foam sheet). This upper interconnection forming the neck includes a threaded seam 10 on top of the final bonding 9 as a continuous band. The thread 10 is taken in the bonding zone and is hence insulated from the environment and from the user (absence of wicking in case of humidity). A hood is also integral to the upper panel 2 around the neck. The hood is formed by the assembly of two substantially triangular panels of cloth bonded together.

Pockets 7 are made on the lateral lower panels 6*a* and 6*b* by bonding inside the vest pieces of cloths and cutting out an aperture in the vest opposite the piece of cloth. Cloth flaps are moreover arranged and bonded to the outer face of the vest in order to cover said apertures.

The realisation of the garment is particularly simple since it is possible to assemble the external panels and the cloth lining and the foam sheet in a single high frequency bonding operation, the foam sheet being sandwiched between the external cloth and the lining cloth in bonding bands, which secure maintenance thereof.

It should be understood that the invention may be provided in various fashions without departing from its general framework. In particular, the lining with its foam sheets may extend (a single continuous panel of lining or several panels forming a single zone of lining or several zones of independent linings) with other sections of the vest, such as for example the sleeves. The thickness of the foam sheet may be constant or vary according to its location, let alone several thicknesses of piled up sheets, such as for example an extra thickness at the shoulders (protection/dampening opposite a harness or a life vest for instance). Similarly, the number and the distribution of the panels may be different, for instance a single lower panel instead of three. The structure of the panels may be different, for instance with added sleeves fixed to the upper panel (or other according to the distribution/structure of the panels). Additional means of interconnection may be implemented in particular to prevent the foam sheet which is substantially free at surface in the lining from moving such as for instance bonding spots or gluing spots between the lining panel 4 (possibly and/or the external panel) and the foam sheet in the centre of the lining. Ventilation apertures, for example eyes, in the arm-pits and/or fastening strings for the hood and/or the bottom of the vest may also be implemented.

The invention claimed is:

1. A protective garment, comprising:

a water-tight and air-tight outer cloth formed by superimposing an external layer of a film of polyvinyl chloride and an internal layer of woven cloth, the film and the woven cloth being bonded together, wherein at least one upper section of the garment is lined internally by a lining made with a cloth formed from material having a same composition as said water-tight and air-tight outer cloth and includes a foam sheet extending in said lining, the cloth of the lining being bonded at least on a periphery thereof to a woven section of said water-tight and air-tight outer cloth in bonding zones, the foam sheet being arranged substantially free between the cloth of the lining and said water-tight and air-tight outer cloth, said foam sheet being integral with said water-tight and air-tight outer cloth and/or with the cloth of the lining at least towards the foam sheet's upper section in order to be held and not to fall in said lining, the lining being arranged at the upper section of the garment on the shoulders and on the upper sections of the thorax and the back by running over proximal openings of the sleeves, said lining being more extended vertically on the back than on the thorax, and the bonding zones are continuous bands arranged at the periphery of the cloth of the lining and closing the inside of said lining substantially water-tight and air-tight.

2. The garment according to claim 1, wherein said garment is a vest.

3. The garment according to claim 1, wherein the garment has a substantially vertical aperture complete from top to bottom by the front, the aperture including at least one of the following removable closing members: a hook-and-loop fastener, a zip fastener, or snap buttons.

4. The garment according to claim 1, wherein said garment is composed of an overlapping abutting assembly of panels cut in the cloth.

5. The garment according to claim 1, wherein the lining is formed of a single panel.

6. The garment according to claim 1, wherein the cloth of the lining has the same orientation as the cloth of the garment, the film of the lining being opposite the woven section of the garment.

7. An oilskin-type sleeved protective vest, comprising:

a water-tight and air-tight external cloth formed by superimposing an external layer of a film of polyvinyl chloride and an internal layer of woven cloth, the film and the woven cloth being bonded together, wherein at least one upper section of the vest is lined internally by a lining made with a cloth formed from material having a same composition as said water-tight and air-tight external cloth and includes a foam sheet extending in said lining, the cloth of the lining being bonded at least on a periphery thereof to a woven section of said water-tight and air-tight external cloth in bonding zones, the foam sheet being arranged substantially free between the cloth of the lining and said water-tight and air-tight external cloth, said foam sheet being integral with said water-tight and air-tight external cloth and/or with the cloth of the lining at least towards the foam sheet's upper section in order to be held and not to fall in said lining, the lining being arranged at the upper section of the vest on the shoulders and on the upper sections of the thorax and the back by running over proximal openings of the sleeves, said lining being more extended vertically on the back than on the thorax, and the bonding zones are continuous bands arranged at the periphery of the cloth of the lining and closing the inside of said lining substantially water-tight and air-tight.

8. The vest according to claim 7, wherein the vest has a substantially vertical aperture complete from top to bottom by the front, the aperture including at least one of the following removable closing members: a hook-and-loop fastener, a zip fastener, or snap buttons.

9. The vest according to claim 8, wherein said vest is composed of an overlapping abutting assembly of panels cut in the cloth.

10. The vest according to claim 7, wherein said vest is composed of an overlapping abutting assembly of panels cut in the cloth.

11. The vest according to claim 10, wherein said vest includes four panels, a neck upper panel, a back lower panel and two lateral lower panels, the upper panel including cutouts and bondings intended for forming sleeves, each lateral edge of the back lower panel abutting against a corresponding lateral edge of the corresponding lateral lower panel along a substantially vertical bonding zone starting essentially at the lower section of the proximal end of the corresponding sleeve.

12. The vest according to claim 7, wherein the lining forms a single panel.

13. The vest according to claim 7, the cloth of the lining has the same orientation as the cloth of the vest, a film of the lining being opposite the woven section of the vest.

* * * * *